United States Patent [19]

Persson

[11] Patent Number: 4,869,387

[45] Date of Patent: Sep. 26, 1989

[54] METHOD FOR TRANSPORT OF ONE UNIT PACKED PRODUCTS WHICH GIVE OFF MOISTURE AND NEED COOLING, AND PACKINGS FOR USE IN CARRYING OUT SAID METHOD

[75] Inventor: Christer Persson, Rena, Norway

[73] Assignee: Renaco, Rena, Norway

[21] Appl. No.: 160,419

[22] Filed: Feb. 25, 1988

[30] Foreign Application Priority Data

Mar. 3, 1987 [NO] Norway ..... 870870

[51] Int. Cl.[4] ..... B65D 1/24; F25D 3/08

[52] U.S. Cl. ..... 220/20.5; 220/4 D; 220/400; 206/508; 206/204; 229/119; 62/371

[58] Field of Search ..... 220/20.5, 4 C, 4 D, 220/400, 408, 23.83; 229/119; 206/204, 488, 508, 514, 505, 577, 564, 565

[56] References Cited

U.S. PATENT DOCUMENTS

| | | | |
|---|---|---|---|
| 1,097,774 | 5/1914 | Shapiro | 220/400 |
| 3,342,401 | 9/1967 | Kitchell | 229/119 |
| 3,412,888 | 11/1968 | Andrews et al. | 206/508 |
| 3,908,852 | 9/1975 | Ricobene et al. | 220/4 D |
| 3,915,532 | 10/1975 | Ashton | 220/400 |
| 3,937,390 | 2/1976 | Winkler | 206/448 |
| 4,078,701 | 3/1978 | Clubb | 220/4 D |
| 4,147,277 | 4/1979 | Bateman et al. | 220/400 |
| 4,341,091 | 7/1982 | Minter | 206/508 |
| 4,351,165 | 9/1982 | Gottsegen et al. | 220/4 E |
| 4,364,477 | 12/1982 | Stromberg | 220/7 Z |

*Primary Examiner*—Willis Little

*Attorney, Agent, or Firm*—Mason, Fenwick & Lawrence

[57] ABSTRACT

A method for transport of one-unit packed products giving off moisture and requiring cooling without any direct contact with a cooling medium, e.g. crushed ice, with use of an outer packing means comprising a tray/-box which opens upwards and has a cover and a double bottom comprising an upper bottom member with drainage apertures, and a lower watertight bottom member, and a sorbent for moisture placed in a space between bottom members. The one-unit products are placed in liquid tight trays/boxes opening upwards which are closed by covers provided with drainage apertures. One or a plurality of trays are placed with cover facing down in the case, whereupon cooling medium is provided on and, if desired, around the bottoms, and side walls of trays, and the case is closed by the aid of the cover. Moisture given off from the one-unit packed product, and any water from the melting cooling agent will flow down through drainage apertures of upper bottom member and will be absorbed by absorbent.

21 Claims, 1 Drawing Sheet

Figure 1:
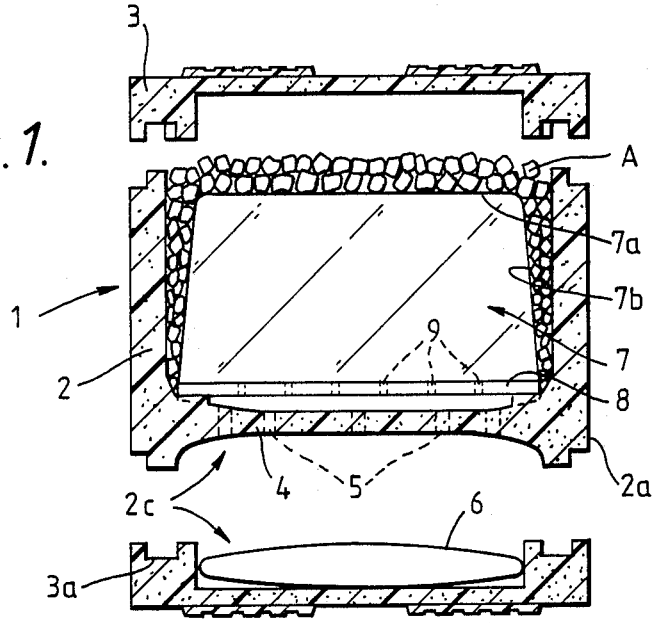

METHOD FOR TRANSPORT OF ONE UNIT PACKED PRODUCTS WHICH GIVE OFF MOISTURE AND NEED COOLING, AND PACKINGS FOR USE IN CARRYING OUT SAID METHOD

The present invention relates to a method for transport of one-unit packed products which give off moisture and need cooling without being in direct contact with the cooling agent, e.g. crushed ice, with use of an outer packing. Furthermore, the invention relates to a packing means for use in carrying out said method.

The above method and packing means primarily concern transport and distribution of food products, e.g. fresh filets of salmon, trout, or other fish, e.g. herring.

A problem arising in connection with transport of fresh filets is that in addition to the fact that the filets should not be in direct contact with crushed ice for reasons of quality the filet itself gives off moisture in the form of liquid. In order to prevent a reduction of quality due to the fact that the lowermost filet layer in a tight package remains lying in the liquid given off, such liquid should also be drained off together with water from the melting ice when the cooling medium is crushed ice.

At present no optimal solution to this problem is known, and it is, thus, an object of the present invention to provide a method, and a packing means solving the above mentioned problem.

For carrying out the invention the filets are packed in a suitable tray/box as regards material, dimensions, and shape, and fitting into an outer packing means complying with the present requirements to packing means for airfreight or motor transport, e.g. RCBS 8325/8319, 8423/25, or 6418—motor vehicle—or the present standard 25 kg polystyrene box, or the like.

The tray/box may be a moulded, vacuum formed, or thermo formed plastic tray having a snap cover. It is filled with filets and the cover is applied. The cover is provided with drainage means, e.g. apertures in the cover.

The completed one-unit packs of filets or other products in said trays/boxes are placed in one of the above mentioned approved means bottom-up and with the cover facing down. The necessary quantity of cooling medium, e.g. crushed ice, is then provided on top of and around the walls and upwards facing bottoms of the trays/boxes, and then the cover is placed on the outer packing. Also, an absorbent is placed in a chamber in the double bottom of the packing means to absorb moisture flowing down and being drained through the upper bottom portion of the packing means.

During transport of the packing means with one-unit packed products, which may take up to 4–5 days, with the above mentioned method, moisture will be drained from the one-unit packed product through or via the cover of the tray/box together with water from melted ice lying on top of and around the one-unit packs and keeping said one-unit packed products cooled without any direct contact between the cooling medium and the product. When packing means with one-unit packed products arrive at the recipient's, e.g. a super market in a different country, the one-unit packed product unit(s) may be removed from the outer packing and they may be turned to have the cover uppermost and to function as suitable moisture impervious shop packs for further distribution of the product. If a moisture impervious one-unit pack is desired the drainage apertures in the cover of the tray/box may be sealed by tape.

By the aid of the above method the product will arrive at the consumer's with its quality intact, i.e. the quality of the product has not deteriorated in spite of the fact that the product was handled several times, which is common today, the product being packed in bulk container means which are transported in a cooled state, whereupon the product is repacked at the recipient's into suitable shop packs. under these conditions the product may also remain in the liquid it gave off which may cause discoloring or a watery product, etc.

The one-unit packed means, i.e. trays/boxes containing the product, now be distributed to the shops by refrigerated motor vehicle.

Figure 2:
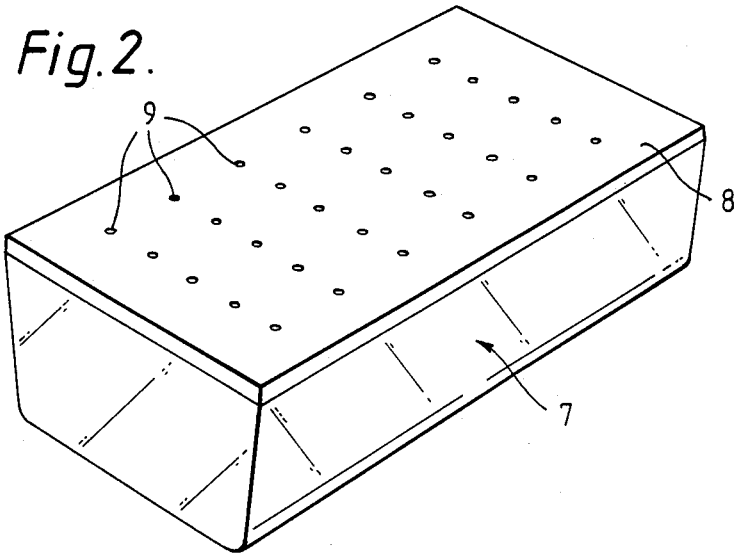

The method and packing means for carrying out said method will be disclosed in more detail below with reference to the drawings, wherein FIG. 1 is a sectional view through the packing means in an exploded arrangement of various parts, and FIG. 2 shows a one-unit packed product unit in the shape of a tray/box placed bottom-down.

The packing means comprise an outer packing 1 provided with a box/case 2 of a watertight material opening upwards, with a cover 3, and a double bottom 4, 3*a* comprising an upper bottom member 4 having draining apertures 5, and a lower moisture impervious bottom member 3*a*. Said bottom members are spaced apart to form a chamber 2*c* intended for receiving a moisture sorbent 6.

A packing means for storage/transport of products that give off moisture, e.g. fresh iced fish products and fresh meat products, which is especially suited is described in Norwegian patent application No. 85 0698 filed by the applicant.

Said packing means is provided with a double bottom 4, 3*a* with a space 2*c* between them being achieved by extending the lower edges 2a of the side walls 2 of the case downwards past the bottom member 4 of case 2 so that space 2*c* is provided with an opening downwards for insertion of an absorbent 6. Lower bottom member 3*a* consists of a cover for closing space 2*c*, with an inserted absorbent 6.

Upper and lower covers 3, 3*a* of the packing means may, advantageously, be identical.

In addition to the above mentioned known outer packing 1, the packing means according to the present invention comprises an inner packing constituting a watertight tray/box 7 having a cover 8 provided with drainage means, e.g. in the shape of drainage apertures 9, to be placed in a filled state with its bottom 7a up and cover 8 down in case 2 of the outer packing.

According to the method mentioned above for transport of one-unit packed products, one-unit packs are placed in the water-tight trays/boxes 7 opening upwards, which are closed by cover 8 which is provided with drainage apertures 9. One or a number of trays/-boxes 7 with one-unit packs is/are then placed with cover 8 facing down on upper bottom member 4 of the outer packing case 2. Then the cooling medium A, e.g. crushed ice, is placed on top of and around the bottoms 7*a* and side walls 7*b* of trays/boxes 7, and case 2 is then closed by cover 3.

Moisture given off from the one-unit packed product will flow through drainage apertures 9 in cover 8 and will flow down, together with water from melted cooling medium A, to and through drainage apertures 5 of upper bottom member 4 to be absorbed by absorbent 6 which is placed in chamber 2c.

The relative sizes of trays 7 and case 2 of outer packing means 1 may be provided to make case 2 only hold one tray 7, or the relative sizes may permit a number of trays 7 to be stacked in one or more layers in case 2, and with cooling medium A, e.g. crushed ice, being provided on top of, around, and between layers.

Having described my invention, I claim:

1. A shipping and storing assembly for products which give off moisture and require cooling without direct contact with the cooling medium, said assembly comprising:

(a) an outer container comprising a box including a cover, peripheral wall means and a bottom cooperating to define a container holding chamber, said bottom including a plurality of drainage openings for permitting drainage of said container holding chamber, and base means detachably mounted on the lower extent of said peripheral wall means and defining a moisture receiving chamber positioned below said drainage openings;

(b) an inner container removably positioned in said container holding chamber comprising a box-like means including a liquid impervious top member, a liquid impervious side means extending downwardly from said top member and a removable bottom cover cooperating to define a storage chamber, said removable bottom cover including a plurality of drain perforations for permitting liquid to drain from said storage chamber;

(c) said portion of said container holding chamber surrounding said inner container being of sufficient volume and shape to receive and hold a cooling medium; and (d) wherein said cover is removably mounted on said outer container for permitting the positioning of said inner container in said container holding chamber.

2. An assembly as recited in claim 1, additionally including a moisture sorbent means in said moisture receiving chamber.

3. An assembly as recited in claim 1, wherein said outer container and said inner container are of approximate quadrilateral plan configuration.

4. An assembly as recited in claim 3, wherein said outer container and said inner container are of approximate rectangular plan configuration.

5. An assembly as recited in claim 3, wherein said liquid impervious side means are generally planar walls tapering inwardly from bottom to top.

6. An assembly as recited in claim 2, wherein said outer container and said inner container are of approximately quadrilateral plan configuration.

7. An assembly as recited in claim 6, wherein said outer container and said inner container are of approximate rectangular plan configuration.

8. An assembly as recited in claim 6, wherein said liquid impervious side means are generally planar walls tapering inwardly from bottom to top.

9. An assembly as recited in claim 1, further including a second inner container positioned is said container holding chamber in vertical alignment with said first mentioned vertical container.

10. An assembly as recited in claim 2, further including a second inner container positioned is said container holding chamber in vertical alignment with said first mentioned vertical container.

11. An assembly as recited in claim 1, wherein said cooling medium is a quantity of ice surrounding and contacting said top and said side means of said inner container.

12. An assembly as recited in claim 2, wherein said cooling medium is a quantity of ice surrounding and contacting said top and said side means of said inner container.

13. An assembly as recited in claim 5, further including a second inner container positioned is said container holding chamber in vertical alignment with said first mentioned vertical container.

14. An assembly as recited in claim 8, further including a second inner container positioned is said container holding chamber in vertical alignment with said first mentioned vertical container.

15. A method for packing and cooling perishable products which give off moisture and require cooling without direct contact with a cooling medium, said method comprising the steps of:

(a) positioning said perishable product in an inner container;

(b) positioning said inner container in an outer container;

(c) providing a quantity of ice in said outer container in contact with said inner container for cooling said inner container without contact of the ice or moisture therefrom with said perishable product;

(d) permitting liquid from said perishable product to drain from said inner container into said outer container; and (e) permitting said liquid and said melt to drain into a bottom portion of said outer container.

16. The method of claim 15, wherein step (a) is followed by covering an upwardly facing opening in said inner container with a perforated lid and inverting said inner container with said attached perforated lid and said product therein following which step (b) is effected.

17. The method of claim 15, wherein step (e) is effected by permitting said liquid and said melt to drain on to a sorbent means in said bottom portion of said outer container.

18. The method of claim 15, wherein said perishable product is fish or meat.

19. The method of claim 15, wherein step (c) is followed by the steps of:

(c1) positioning an additional amount of said perishable product in an additional inner container;

(c2) positioning said additional inner container in said outer container;

(c3) providing a layer of ice surrounding and contacting said top and said side means of said additional inner container;

(c4) repeating steps (c1), (c2) and (c3) until the desired number of said additional inner containers are positioned in said outer container, following which step (d) is effected, and followed by the steps of:

(d1) permitting liquid from said perishable product to drain from at least one of said additional inner containers into said outer container, following which step (e) is effected.

20. A method according to claim 15, further comprising the steps of:

transporting said second container with said inner container therein to a desired destination, inverting said inner container so that said perforated lid faces up without allowing moisture to enter said inner container, and applying closing means to said inner container to prevent the interaction of said perishable product therein with the environment surrounding said inner container.

21. The method of claim 17, wherein said perishable product is fish or meat.

* * * * *